United States Patent [19]

Noble

[11] 4,088,078

[45] May 9, 1978

[54] LUBRICATING APPARATUS FOR REDUCING SQUEAL NOISE OF A RAILROAD CAR WHEEL WHEN PASSING THROUGH A CAR RETARDER

[75] Inventor: Peter M. Noble, Valencia, Pa.

[73] Assignee: Westinghouse Air Brake Company, Swissvale, Pa.

[21] Appl. No.: 693,269

[22] Filed: Jun. 4, 1976

[51] Int. Cl.[2] ..... B61B 1/00

[52] U.S. Cl. ..... 104/26 A; 104/1 R; 184/3 R; 188/71.1; 188/256

[58] Field of Search ..... 104/26 R, 26 A, 1 R; 188/62, 71.1, 256, 264 B; 184/3 R

[56] References Cited

U.S. PATENT DOCUMENTS

| | | | |
|---|---|---|---|
| 3,111,197 | 11/1963 | Pollmann | 188/62 |
| 3,716,114 | 2/1973 | Beck | 188/62 |
| 3,809,188 | 5/1974 | Frank et al. | 188/62 |

*Primary Examiner*—Drayton E. Hoffman
*Assistant Examiner*—Randolph A. Reese
*Attorney, Agent, or Firm*—R. S. Visk; R. W. McIntire, Jr.

[57] ABSTRACT

Apparatus disposed in parallel relation to rails of a railway track section ahead or in advance of a railroad car retarder for applying a solid type lubricant to those areas of the car wheels frictionally contacted by the retarder and thereby suppressing excessive noise or squealing during retarding action.

3 Claims, 4 Drawing Figures

LUBRICATING APPARATUS FOR REDUCING SQUEAL NOISE OF A RAILROAD CAR WHEEL WHEN PASSING THROUGH A CAR RETARDER

BACKGROUND OF THE INVENTION

It has been established by tests that application of a lubricant, usually a petroleum base, to those surfaces of the wheels of a railroad car frictionally engaged by a railroad car retarder when the car is slowed down thereby, will reduce or eliminate the tendency of the car wheels to squeal. Since the squeal noise often made by the car wheels as the car is being retarded is far higher in noise level, measured in decibels on the A scale (dbA), than is allowed by the Occupational Safety Hazard Agency (O.S.H.A.) standards and noise pollution limits established by many communities, means for controlling noise is vital to railroads, especially for yard classification operations.

At present, the more commonly used lubricant is a water soluble oil diluted with water and anti-freeze generally mixed in a ratio of one part oil to ten parts dilutant. Apparatus is provided for spraying the mixture onto the car wheels either before the railroad car enters the retarder or while it is moving therethrough. This method presents inherent undesirable disadvantages, namely: (a) the spray cannot be sufficiently controlled for preventing such spray from spreading over areas of the wheel not needed to be lubricated; (b) lubricating fluid must contain such dilutants as anti-freeze and fuel oil in order to prevent freezing thereof in sub-freezing temperatures; (c) pressure operated spraying apparatus for spraying the fluid along with sumps and sump pump systems for recovering and recirculating the lubricating fluid must be provided; (d) fire hazards presented by flammable lubricating liquids; (e) slippery conditions and surfaces prevailing in the retarder area due to the spray; and (f) the many maintenance problems attendant with a spraying system, fluid levels, pumps, filters, sumps, etc.

SUMMARY OF THE INVENTION

The object of the present invention, therefore, is to provide lubricating apparatus for lubricating only those areas of railroad car wheels, which normally are frictionally engaged by a railroad car retarder, for suppressing possible squealing noise normally attendant with retarder operation, such lubricating apparatus being characterized, among others, by such advantages as minimum maintenance, effectiveness during all normal seasonal temperatures, absence of hazards from slippery areas and possible fires due to flammable fluid type lubricants, and trouble free operation.

Briefly, the invention comprises a pair of chambers of rectangular cross section with one side open and disposed parallel to and on opposite sides of each rail of a railway track section, which is located in advance of a railroad car retarder, each of said rectangular channels containing a solid type lubricant exposed through the open sides of the channels in facing relation to the vertical sides of the rails from which the channels are appropriately spaced so that, as the car wheels pass through the lubricating apparatus and along the open sides of the channels, the vertical peripheral areas of said wheels make contact with the lubricant and are coated therewith. Thus, the areas of the wheels, and only those areas, that will be frictionally engaged by the retarder are effectively lubricated for eliminating or effectively reducing the possible squealing noise of the wheels passing through the car retarder. In the drawings:

DESCRIPTION AND OPERATION

Figure 1:
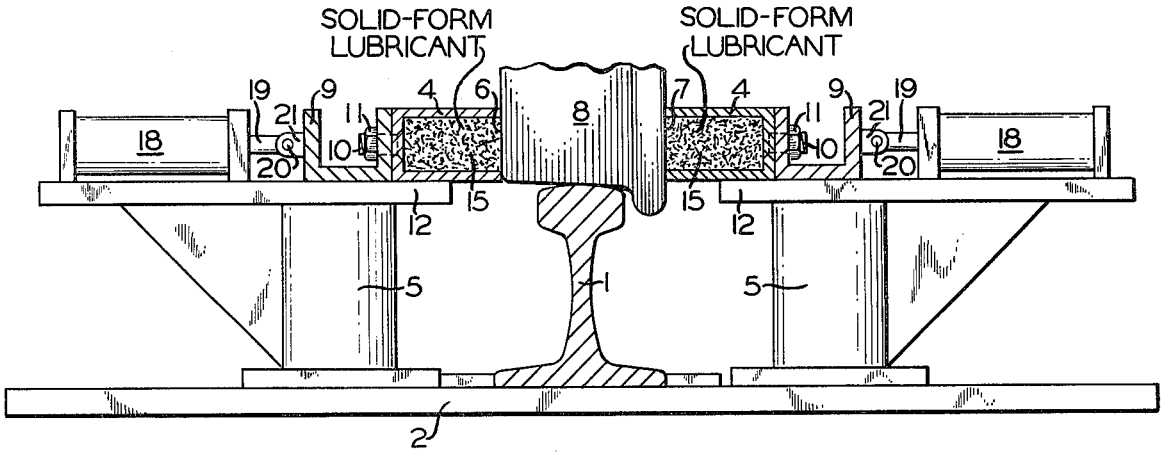
FIG. 1 is an elevational view, mostly in section, of a lubricating apparatus embodying the invention as disposed relative to a rail of a railway track section.
Figure 3:
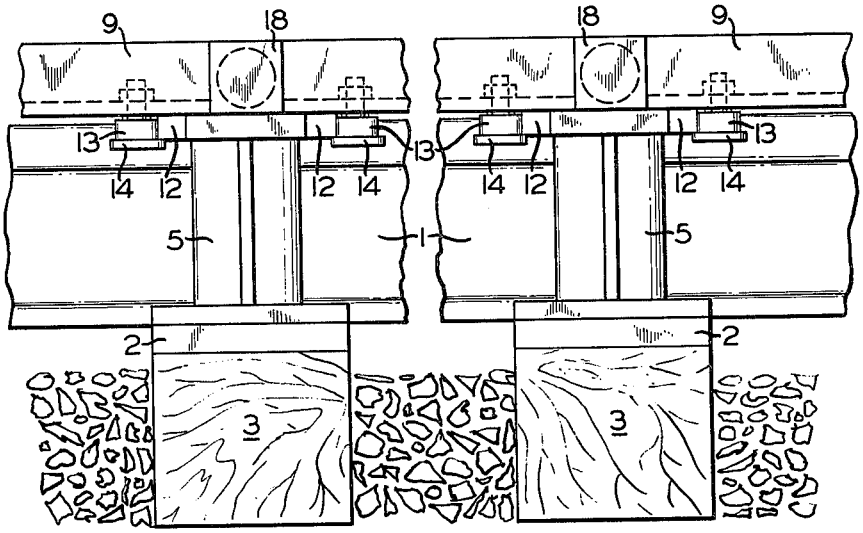
FIG. 3 is an elevational view, in outline, of the lubricating apparatus as viewed from either the left or right side of FIG. 1.

A railway track section, as shown in FIG. 1, on which lubricating apparatus embodying the invention is secured, comprises rails 1 (only one of which is shown) secured by special tie plates 2 to cross ties 3 (see FIG. 3 also).

The lubricating apparatus comprises elongated protective channel members 4 of rectangular cross section having one side open, said channel members being arranged parallel to and one on each side of each rail 1 with the open sides thereof facing inwardly toward the rail. Channel members 4 are supported by respective support platforms 5 at approximately the same heighth as are the brake shoes (not shown) of a railroad car retarder (not shown), said support platforms being secured by suitable means (not shown) to the special tie plates 2. Normally the brake shoes of a car retarder are positioned at such a heighth as to frictonally engage vertical annular surfaces 6 and 7 on opposite sides of a wheel 8 (only a portion of which is shown) adjacent the periphery of said wheel.

The lubricating apparatus is located on the railway tracks at a position ahead of the car retarder, that is, a position such that the car passes through the lubricating apparatus before it passes through the retarder. As will later be explained, because of the nature of the invention herein disclosed, the distance between the lubricating apparatus and the retarder is not critical.

The length of channel members 4 is determined by the tread circumference of the largest car wheels to pass through the lubricating apparatus, such as the wheel 8 shown in FIG. 1, a typical circumference of such a wheel being 10.5 feet, for example. Each of the channel members 4 is backed and, thereby, provided with further rigidity by respective support channel members 9 also of rectangular cross section with an open side facing upwardly. Channel members 4 are abuttingly secured to support channel members 9 by a plurality of threaded studs 10 fixed in channel members 4 in suitably spaced disposition therealong and extending through the abutting inner walls of both channel members to be secured by vibration proof nuts 11, as shown in FIG. 1.

Channel members 4 and 9, on each side of rail 1, are slidably mounted on slide plates 12 fixed horizontally on top of the respective support platforms 5, thus permitting lateral movement of said channel members inwardly toward rail 1 or outwardly away therefrom. Lateral movement of channel members 4 and 9 is guided by guide rollers 13 carried underneath the channel members 9 in such position as to have one each of said rollers rollingly engaging each side edge of slide plates 12. Each roller 13 is provided with a flange 14 which rides on the underside of slide plate 12 thereby preventing undesirable vertical and parallel displacement relative to rail 1 of each pair of channel members 4 and 9, so that the correct attitude of the open side of channel member 4 relative to the rail is maintained.

Each of the channel members 4 has molded or cast therein a slug 15 or solid form lubricant such as ski wax, for example, which, in a manner to be hereinafter described, is pressed against and applied to the surfaces 6, and 7 of each car wheel as it passes through the lubricating apparatus. The protective channel members 4 themselves are made of such metal or other material of sufficient rigidity as to provide adequate support for the lubricant slug 15, and of such wearing quality as to permit the edges of the open sides of said channel members to wear along with the lubricant slug so that the lubricant is always in position for contact with the wheel surfaces 6 and 7. When the lubricant slug 15 and channel member 4 are worn to a degree of ineffectiveness, the arrangement of studs 10 and nuts 11 facilitate immediate replacement with new channels and slugs.

Figure 4:
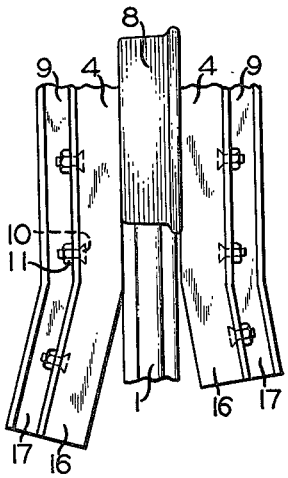
FIG. 4 is a partial plan view, in outline, of a particular detail of construction of a certain portion of the lubricating apparatus.

As shown in FIG. 4, respective entry portions 16 and 17 of each pair of channel members 4 and 9 are flared outwardly away from rail 1 to facilitate a smooth entry of the car wheel 8 between them. Furthermore, as illustrated, the outer pair of channel members 4 and 9, that is, the pair positioned on the outside of rail 1, projects slightly beyond the end of the oppositely positioned or inner pair of channel members. Since both the inner and outer pairs of channel members 4 and 9 are identical in construction and symmetry, the opposite or exit ends are constructed similarly to the entry ends which provides the advantage that they may be interchangeably installed on either side of rail 1.

Figure 2:
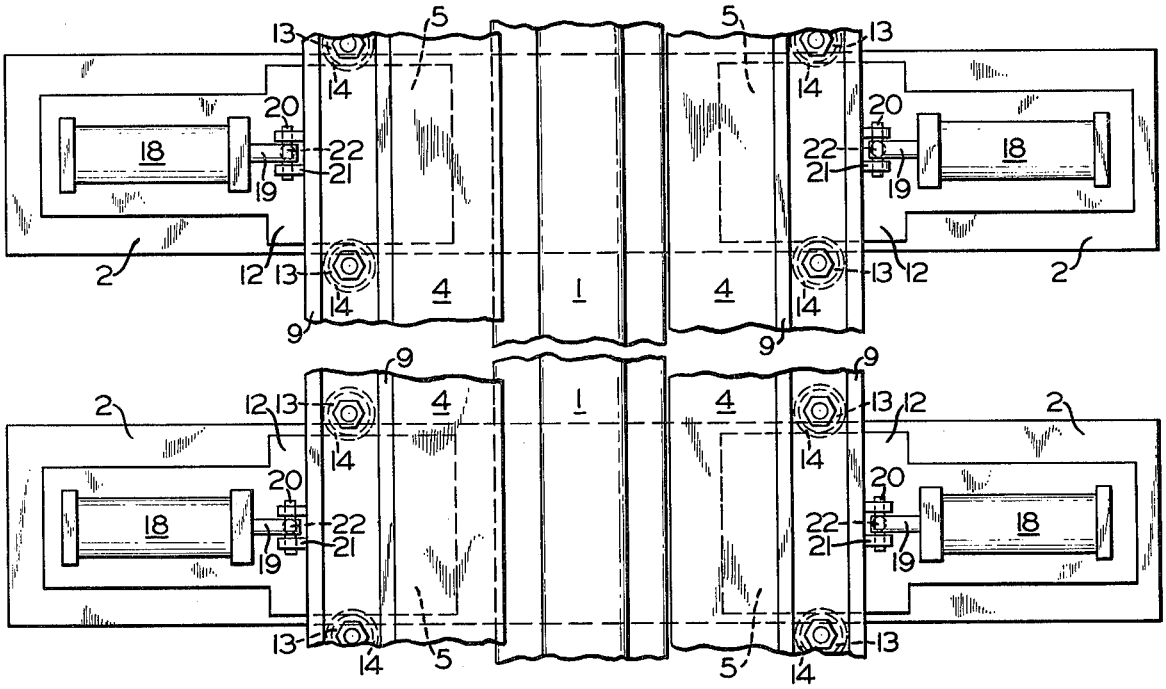
FIG. 2 is a plan view, in outline, of the lubricating apparatus shown in FIG. 1.

Movement of the channel member pairs 4 and 9 into and out of contact with surfaces 6 and 7 on opposite sides of wheel 8 is effected by double-acting fluid pressure operable piston devices 18 mounted on each of the support platforms 5 with the action thereof directed perpendicularly to said channel member pairs. See FIGS. 1 and 2. A piston rod 19 of each of the piston devices 18 is operably connected to the respective channel member pair 4 and 9 by a pin 20 passing perpendicularly through the free end of said piston rod and a clevis 21 secured to channel member 9. The connection between pin 20 and the end of piston rod 19 comprises a ball and socket type bushing 22 for eliminating lateral thrust effects.

Suitable valving (not shown) may be employed for maintaining a predetermined constant degree of piston pressure acting on channel member 4 through channel member 9, and, therefore, provide the desired degree of pressure lubricant 15 against surfaces 6 and 7 of wheel 8. Thus, variations of wheel thickness and spacing thereof on the axles have no effect on the pressure applied by the lubricant 15 on surfaces 6 and 7. By carefully determining the desired pressure between lubricant 15 and surface 6 and 7, and the thickness and wearing qualities of the material comprising channel member 4, the amount of lubricant applied to surfaces 6 and 7 of wheel 8 can be accurately controlled.

As the wheel 8 passes through the lubricating apparatus, a thin coat of lubricant from the respective slugs 15 is applied to surfaces 6 and 7, that is, the same surfaces that will be frictionally engaged by the brake shoes (not shown) of the car retarder (not shown) as the car passes out of said lubricating apparatus into the car retarder. Because of the solid form of lubricant 15, lubrication is applied and limited to surfaces 6 and 7 only of the wheel and does not spread over other areas, such as the running surface, of the wheel as do the liquid type lubricants which are sprayed and, therefore, cannot be controlled and confined to surfaces 6 and 7 only. Thus, squeal is effectively reduced or eliminated as the car wheel 8 is subsequently engaged by the retarder.

As was previously herein noted, the distance of tracks between the lubricating apparatus disclosed herein and the car retarder is not critical, because, due to the nature of the lubricant 15 applied to wheel surfaces 6 and 7, such lubricant adheres to said surfaces, that is, does not run off as a liquid lubricant might do, and remains until the wheel enters the retarder.

Having now described the invention, what I claim as new and desire to secure by Letter Patent, is:

1. Lubricating apparatus for reducing squeal noise of railroad car wheels passing through a railroad car retarder, said retarder mounted along a track rail over which move said car wheels which have respective annular parallel lateral surfaces on opposite sides adjacent the periphery thereof and which surfaces are engaged on both sides by the parallel brake shoes of said retarder, comprising, a. elongated members and support means therefor mounted along said rail ahead of said retarder for positioning said elongated members one on each side of and parallel to the rail at a predetermined spaced-away relation thereto for accomodating rolling movement of the wheel therebetween, b. a lubricant slug complementarily disposed into each of said elongated members in facing relationship to and at such height above said rail to make rubbing contact with the annular lateral surfaces of each passing wheel only for applying thereto a coating of said lubricant to reduce squeal when retarder brake shoes subsequently engage said wheel surfaces, c. said elongated members each comprising, 1. a protective channel member of rectangular cross-section having a length equal to the circumference of the largest wheel moving along said rail and into which said lubricant slug is molded, said protective channel having an open side in facing relation to the rail and through which said lubricant slug makes said rubbing contact with the adjacent lateral surface of the wheel, and 2. a support channel member of rectangular cross-section to which said protective channel member is secured to provide rigidity therefor, and d. means carried on said support means for urging said elongated members and the lubricant slugs disposed therein into said rubbing contact with said lateral surfaces with a predetermined degree of pressure.

2. Lubricating apparatus, as set forth in claim 1, wherein the material comprising said protective channel member, in which said lubricant slug is molded, is characterized by a selected wear quality for effecting wear of the edge surfaces of the open side thereof compatible with the rate of dispensation of the lubricant slug.

3. Lubricating apparatus, as set forth in claim 2, wherein said elongated members are slidably mounted on said support means for lateral movement toward or away from the rail for assuming a predetermined spaced distance therefrom according to the thickness of the wheel, and wherein said means carried on said support means comprises a double-acting piston device mounted on each of the support means and operably connected to the elongated members for automatically maintaining said spaced-away relationship between the elongated members and the rail according to the thickness of the wheels passing therebetween.

* * * * *